US005329978A

United States Patent [19]

Hasegawa

[11] Patent Number: 5,329,978

[45] Date of Patent: Jul. 19, 1994

[54] PLANER

[75] Inventor: Katsuji Hasegawa, Ohbu, Japan

[73] Assignee: Meinan Machinery Works, Inc., Ohbu, Japan

[21] Appl. No.: 52,376

[22] Filed: Apr. 23, 1993

[30] Foreign Application Priority Data

May 1, 1992 [JP] Japan ..... 4-139995
Mar. 18, 1993 [JP] Japan ..... 5-085311

[51] Int. Cl.[5] ..... B27G 13/00

[52] U.S. Cl. ..... 144/225; 144/117 R; 144/218; 144/228; 144/230

[58] Field of Search ..... 144/114 R, 117 R, 162 R, 144/172, 174, 176, 218, 228, 229, 230, 225; 407/40, 41, 49, 50

[56] References Cited

U.S. PATENT DOCUMENTS 2,146,074 2/1939 Kelley ..... 144/176
4,061,169 12/1977 Hasegawa ..... 144/213
4,252,163 2/1981 Onda et al. ..... 144/132
4,658,875 4/1987 Grabovac ..... 144/230

*Primary Examiner*—W. Donald Bray
*Attorney, Agent, or Firm*—Lahive & Cockfield

[57] ABSTRACT

The invention provides an improved planar which effectively prevents undesirable torn grain. The planer of the invention includes at least one planer knife or blade and at least one pressing member, both attached to and supported on a cutterhead. The pressing member includes a head element which is located to have a predetermined angle with respect to the blade and is resiliently movable in a predetermined direction to press an edge of the head element against a certain position of a wood surface immediately before a cutting edge of the blade moving in a fixed direction for cutting or against a boundary between the wood surface and a chip being currently cut from the wood surface. The direct pressing of the pressing member against the wood surface prevents rise of wood fibers and thereby effectively reduces or eliminates undesirable torn or chipped grain.

25 Claims, 11 Drawing Sheets

PLANER

BACKGROUND OF THE INVENTION

1. Field of the Invention

The present invention relates to an improved planer used in woodworking.

2. Description of the Related Art

As widely known, planers are often used for planing by rectilineal cutting in the field of woodworking. A conventional planer typically includes two to four blades attached to a cutterhead of an appropriate width. The planer roughly finishes the surface of wood by cutting chips each having a shape corresponding to a trochoid locus drawn by a cutting edge of each blade.

Up-milling, wherein each blade is rotated in the direction opposite to the feeding direction of wood, has advantages over down-milling, wherein each blade is rotated in the same direction as feeding of wood, and up-milling is thereby applied to most cases of planing with a planer. Such advantages include: shallower and flatter knife marks, little damage to the cutting edge of each blade, and easier disposal of chips.

In the up-milling process, however, the conventional planar generally causes some defects as torn grain or chipped grain, wooly grain or fuzzy grain, and raised grain. Especially, torn grain or chipped grain, which means a wood surface having one or plural cuts deeper than a desirable finished surface, badly affects the subsequent steps of woodworking, and hence effective prevention of torn grain is highly desirable.

Such torn grain may be attributable partly to blades, that is, abrasion or inadequate setting of the cutting edge of each blade, and partly to wood, that is, direction and strength of wood fibers or cross grain. In any case, a cutting force of each blade applied onto a portion of wood shallower than a desired finished surface causes adverse effects on a place of wood deeper than the desirable finished surface to destroy the wood fibers in the deeper portion.

A variety of measures have been taken to prevent such torn grain or chipped grain. One typical example of these measures includes giving an appropriate bevel to a rake face of a blade (a face on which chips slide) in order to make a cutting angle greater than a tooth angle, thereby reducing a component of a cutting force in a direction separating from a surface of the wood to eliminate or reduce effects of the cutting force on a wood portion deeper than a desirable finished surface. Another example of such measures includes mounting a chip breaker on the side of the rake face of a blade or alternatively shaping a part of the cutterhead located on the side of the rake face of a blade as a chip breaker, so as to turn and fold chips and thereby prevent undesirable fore split. Here the fore split means the fracture of wood fibers generated before the cutting edge of each blade, and at least part of such fore split appears as torn grain on the surface of the wood.

Although generally increasing the cutting resistance, these measures reduce the amount of torn grain as long as various cutting conditions, such as the type of wood, direction of fibers, degree of dryness, and undeformed chip thickness of each blade are set within specific ranges. All such measures are, however, directed to portions of the wood located after the cutting edge of each blade, for reducing torn grain generated before the cutting edge of the blade. These indirect methods can not sufficiently prevent torn grain when the cutting conditions are not in the specific ranges. Even when the bevel or chip breaker is finely set according changes in the cutting conditions, these measures are of limited effectiveness.

SUMMARY OF THE INVENTION

The object of the invention is to provide an improved planer which effectively prevents undesirable torn grain.

The above and other related objects are realized by a planer of the invention, which includes a planer knife or blade and a pressing member both attached to and supported on a cutterhead. The pressing member includes a head element which is located to have a predetermined angle with respect to the blade and is resiliently movable in a predetermined direction to bring an edge of the head element into contact with a certain position of a wood surface immediately before a cutting edge of a blade moving in a fixed direction for cutting, or with a boundary between the wood surface and a chip being currently cut from the wood surface; and a foot element having a first end attached to the cutterhead and a second end extending to integrally form the head element, or alternatively being coupled with the head element by means of a fixing member.

The foot element of the pressing member further includes an opening which allows passage of chips and is arranged facing to a space defined by the blade and the pressing member for receiving chips cut from the wood surface.

The edge of the head element of the pressing member directly presses a certain position of a wood surface immediately before a cutting edge of a blade moving in a predetermined direction for cutting or a boundary between the wood surface and a chip being currently cut from the wood surface, thereby effectively preventing undesirable torn grain in planing by rectilineal cutting.

These and other objects, features, aspects, and advantages of the present invention will become more apparent from the following detailed description of the preferred embodiments with the accompanying drawings.

DESCRIPTION OF THE PREFERRED EMBODIMENTS

Preferred embodiments of the invention are described hereinafter based on the drawings, wherein knife marks are omitted, and a surface of wood is shown as flat for clarity of description.

Figure 1:
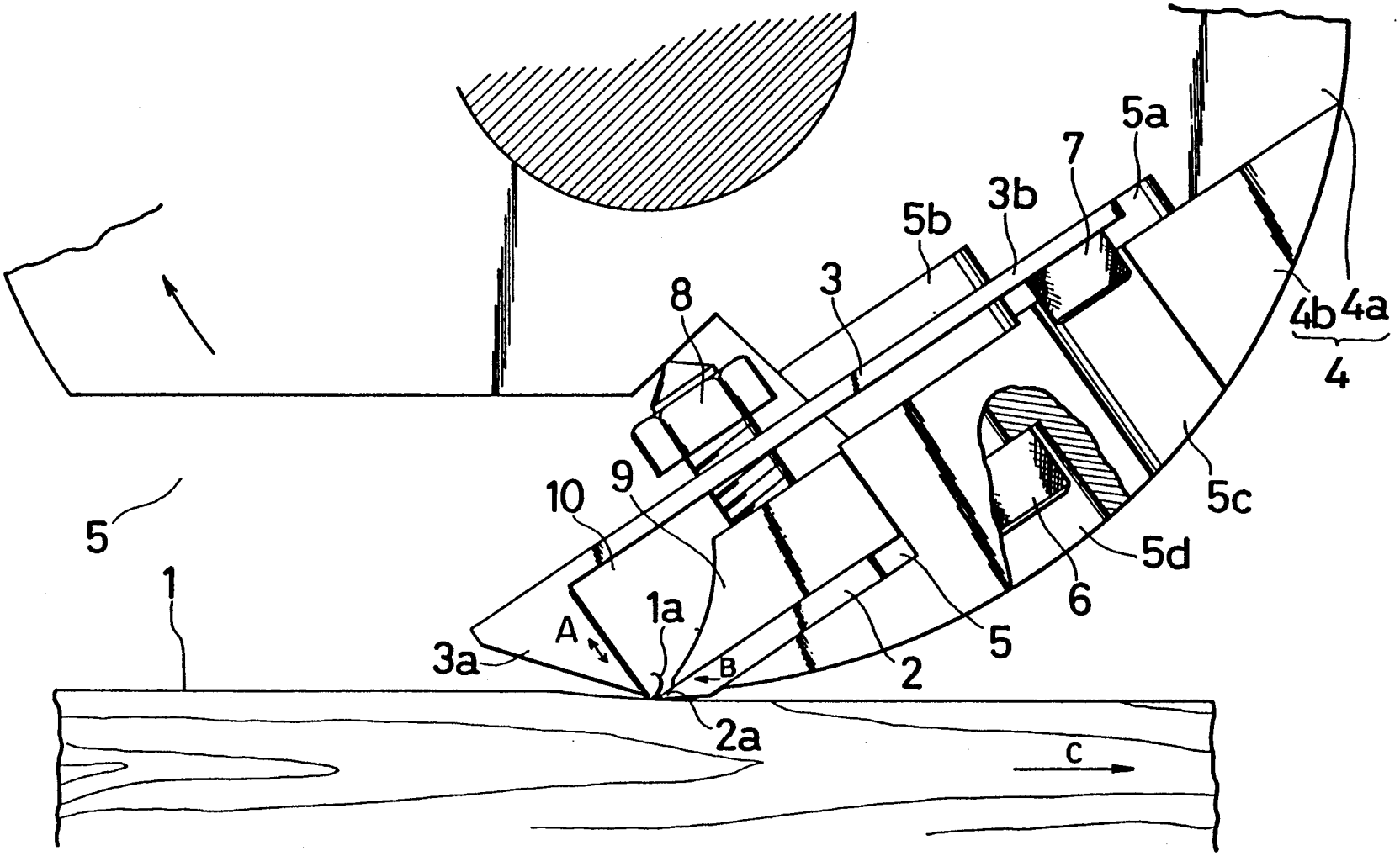
FIG. 1 is a partly broken side view showing part of a planer embodying the invention.

A planer typically embodying the invention includes at least one planer knife or blade 2 and at least one pressing member 3, both attached to and supported on a cutterhead 4 as clearly seen in the side view of FIG. 1. The pressing member 3 includes a head element 3*a* which is located to have a predetermined angle with respect to the blade 2 and is resiliently and alternately movable in a predetermined direction shown by the arrow A of FIG. 1 to bring an edge of the head element 3*a* into contact with a certain position of a wood surface 1 immediately before a cutting edge 2*a* of the blade, 2 moving in a fixed direction shown by the arrow B for cutting (up-milling in the embodiment) or with a boundary between the wood surface 1 and a chip 1*a* being currently cut from the wood surface 1. The pressing member 3 further includes a pair of foot elements 3*b* each having a first end attached to the cutterhead 4 and a second end extending to integrally form the head element 3*a*.

Figure 2:
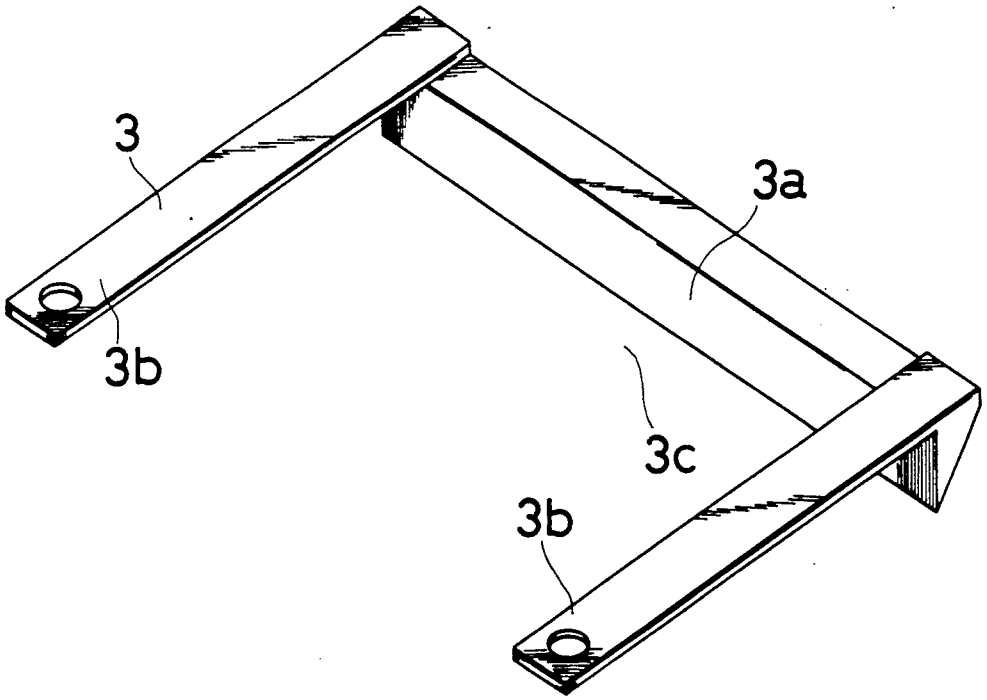
FIG. 2 is a perspective view showing a pressing member incorporated in the planer of FIG. 1.

The head element 3*a* of the pressing member is tapered to have a shape of triangular prism as clearly seen in FIGS. 1 and 2.

There is an opening 3*c* formed between the pair of foot elements 3*b* for allowing passage of chips as shown in FIG. 2. The opening 3*c* is arranged face to a space 10, defined by the pressing member 3 and the blade 2 for receiving chips cut from the wood surface 1. The space 10 forms part of a groove 5 formed in the cutterhead 4 for accommodating the blade 2 and other elements.

The cutterhead 4 further includes: a main body 4*a* having a first step 5*a* for supporting the first end of the foot element 3*b* of the pressing member 3 and a second step 5*b* for defining a space allowing the resilient movement of the pressing member 3; and a cover element 4*b* having a clearance 5*c* for receiving a pair of engaging bolts 7 for fixing the pair of foot elements 3*b* of the pressing member 3 to the main body 4*a*, and a hole 5*d* for receiving a fixing bolt 6 for fixing the cover element 4*b* to the main body 4*a*. Although the cutterhead 4 of this first embodiment includes separate main body 4*a* and cover element 4*b*, the main body 4*a* and the cover element 4*b* of the cutterhead 4 may be formed integrally via the groove 5 formed by boring or electric discharge forming process according to the requirements.

The blade 2 is pressingly attached to the cutterhead 4 via a blade fixing member 9 with a pressing bolt 8. While the blade 2 moves in the fixed direction of the arrow B, wood is moved in an opposite direction as shown by the arrow C.

In the planer thus constructed, even when a cutting force of the blade 2 applied onto a portion of wood shallower than a desirable finished surface affects a place deeper than the desirable finished surface, the head element 3*a* of the pressing member 3 directly presses a certain portion of the wood surface 1 immediately before the cutting edge 2*a* of the blade 2 moving in a fixed cutting direction, or a boundary between the wood surface 1 and the chip 1*a* being currently cut from the wood surface 1, thereby preventing premature rise of wood fibers to effectively reduce or eliminate undesirable torn or chipped grain. The pressing member 3 of the planer directly preventing torn grain has effects much greater than the conventional measures.

Figure 3:
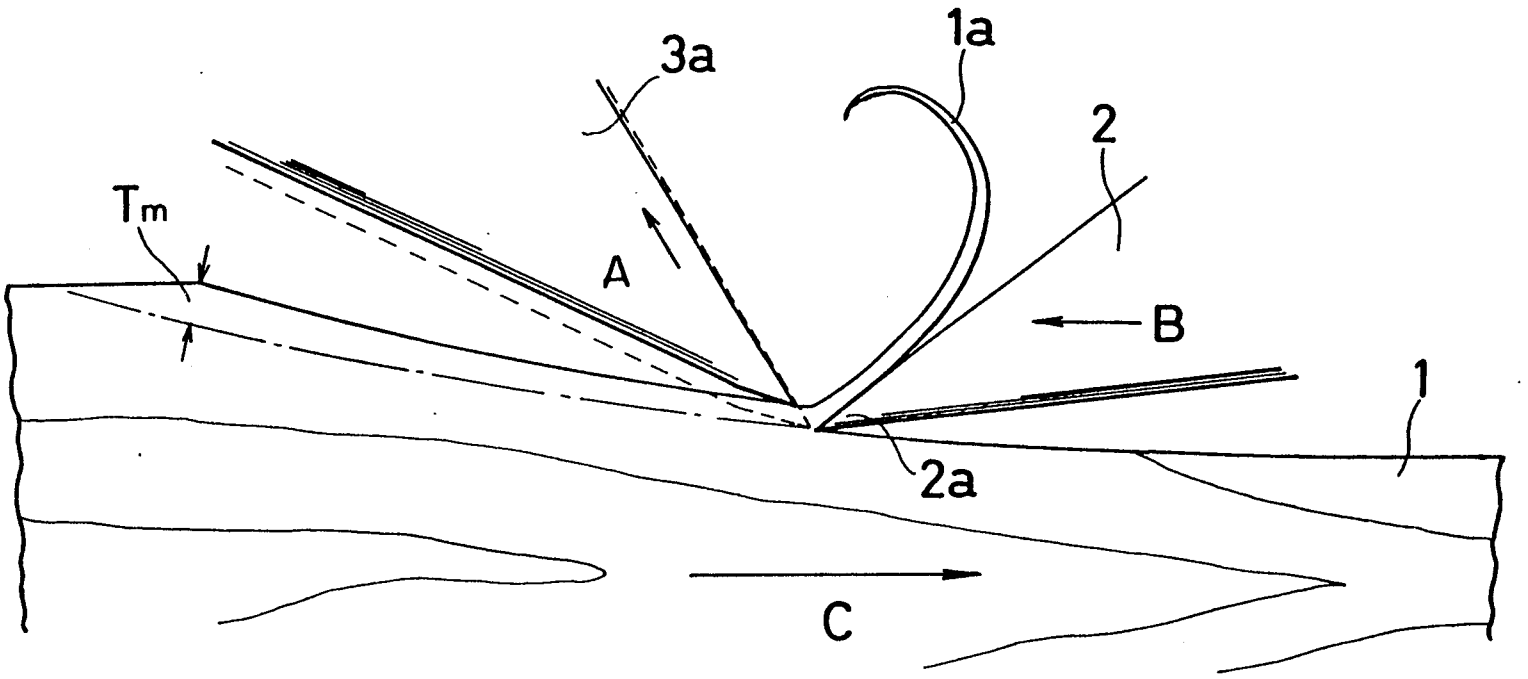
FIG. 3 is an enlarged view illustrating a cutting process by a cutting edge of a blade used in the planer of FIG. 1.

It is theoretically preferable, for the best prevention effect (effect of preventing torn grain), to press the edge of the head element 3*a* of the pressing member 3 against a boundary between the wood surface 1 and the chip 1*a* as shown by the broken line in the enlarged view of FIG. 3. Very fine and troublesome adjustment is, however, required to ensure accurate contact between the edge of the head element 3*a* of the pressing member 3 and the boundary without damaging the cutting edge 2*a* of the blade 2. Since the pressing member 3 is repeatedly used as described later, it is practical to press the head element 3*a* of the pressing member 3 against a certain position of the wood surface 1 a little before the boundary as shown by the solid line in FIG. 3. The prevention effect is naturally lowered as a pressing portion (edge of the head element 3*a* of the pressing member 3 pressed against the wood surface 1) moves apart from the boundary. The results of our experiments have, however, showed sufficient prevention effect even when the pressing portion is apart from the cutting edge 2*a* of the blade 2 by a distance Tm corresponding to the maximum thickness of the chip 1*a*.

A cutting force of a blade generally has adverse effects on a wood portion deeper than a desirable finished surface after a chip currently cut from the wood surface becomes relatively thicker. In an initial stage of cutting wherein the chip is relatively thin, significant torn grain is not observed as long as abrasion of the cutting edge of the blade is within a certain limit. These facts may furnish a basis for the sufficient prevention effect when the pressing portion is apart from the cutting edge of the blade by a certain distance.

The head element 3*a* of the pressing member 3 may be adjusted to be located at a position substantially in contact with the cutting edge 2*a* of the blade 2 or at a certain position slightly apart from the cutting edge 2*a* of the blade 2, in the initial stage of cutting, according various cutting requirements.

The head element 3*a* of the pressing member 3 is tapered to form a triangular prism in this embodiment. The shape of the head element 3*a* is not limited to such a triangular prism but may be changed or altered according to the requirements as long as the edge of the head element 3*a* has a certain degree of sharpness. The edge of the head element 3*a* is covered with an anti-abrasion layer formed according to a known method or alternatively is composed of a known anti-abrasion material for reduction of potential wear.

Since the space 10 for receiving chips cut from the wood surface is relatively small with respect to the size of the chips, the pressing member 3 of the first embodiment has the opening 3*c* FIG. 2, arranged facing to the space 10 for allowing passage of chips and preventing the space 10 from being packed with the chips. When a working width of a planer is relatively small to give a sufficiently large space for receiving chips and allowing passage of chips in a direction transverse to the cutting direction as described later, such opening is not essential.

In the planar of the first embodiment, the foot elements 3*b* are fixed opposite to the head element 3*a* via the space 10. This structure restricts the movement of the edge of the head element 3*a* of the pressing member 3 with respect to the cutting edge 2*a* of the blade 2 while the head element 3a is resiliently movable in the direction of the arrow A. The structure of the first embodiment thus sufficiently prevents undesirable torn grain and prevents chips from remaining between the blade 2 and the pressing member 3.

Other embodiments of the invention are briefly described hereinafter according to the drawings. In the description below and the accompanying drawings, the same numerals denote the same elements.

Figure 4:
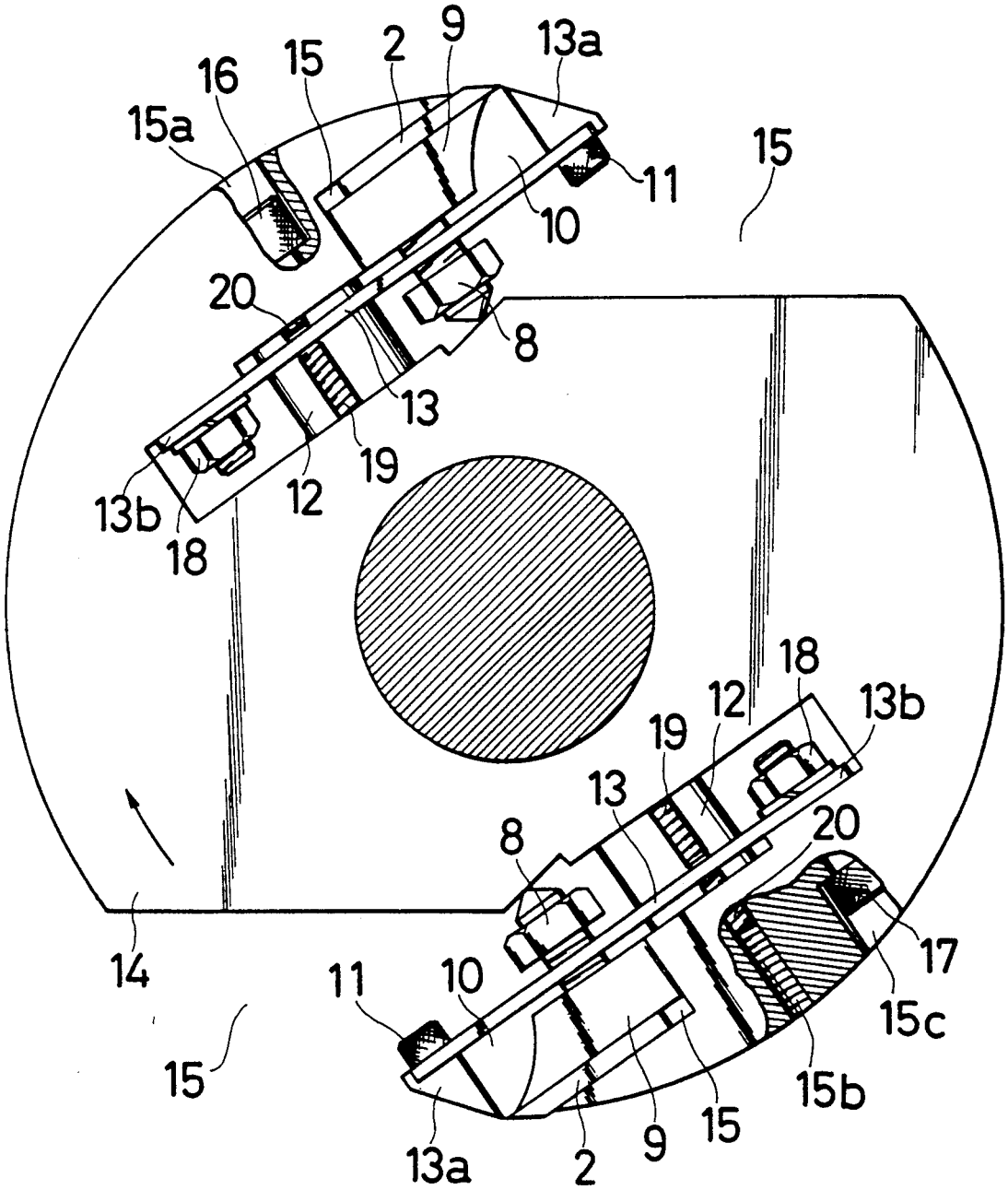
FIG. 4 is a partly broken side view showing a planer according to a second embodiment of the invention.
Figure 5:
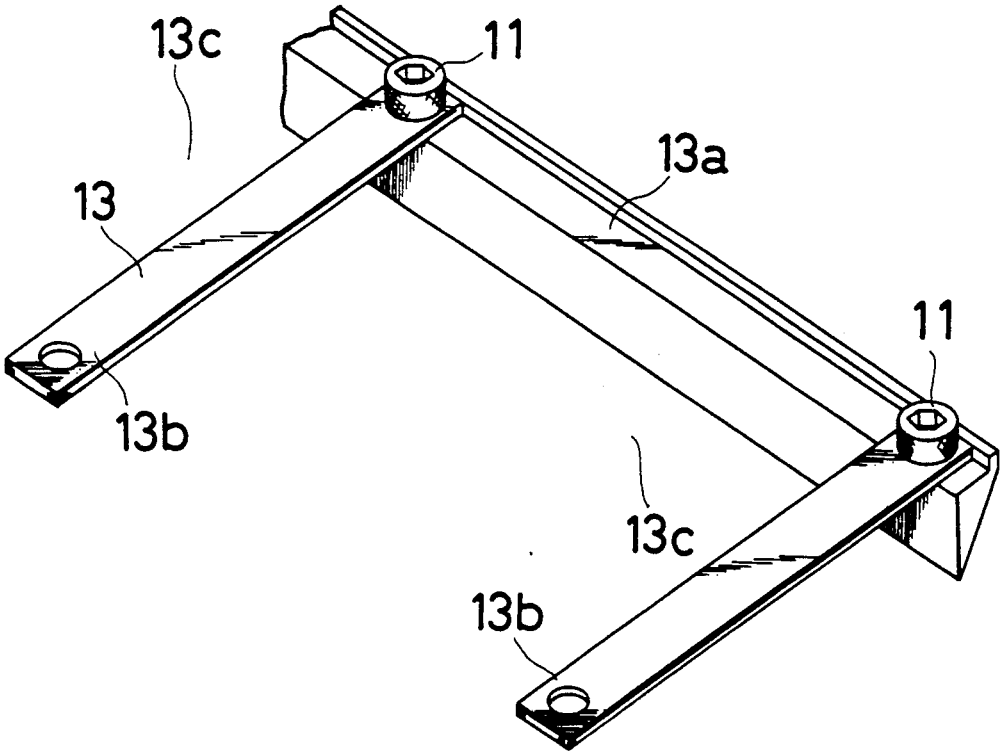
FIG. 5 is a perspective view showing a pressing member incorporated in the planer of FIG. 4.

FIG. 4 shows a planar according to a second embodiment of the invention, and FIG. 5 shows a pressing member 13 incorporated in the planer of FIG. 4. The planer of the second embodiment includes a pair of pressing members 13 and blades 2, both attached to a cutterhead 14 having a pair of grooves 15. As clearly seen in FIG. 5, each pressing member 13 includes a detachable and replaceable head element 13a fixed to plural foot elements 13b by means of plural fixation bolts 11, and an opening 13c formed between the foot elements 13b for allowing passage of chips. The cutterhead 14 symmetrically includes plural first holes 15a each receiving a clamping bolt 16, plural second holes 15b each receiving an adjusting screw 20, and plural third holes 15c each receiving an engagement bolt 17. Each groove 15 is defined to have a fixed width by clamping of the clamping bolt 16 via a cylindrical spacer 12. The foot elements 13b of each pressing member 13 are fixed to the cutterhead 14 by means of the plural (at least three) engagement bolts 17 and engaging nuts 18 corresponding to the engagement bolts 17. An adjusting screw 19 is arranged opposite to each adjusting screw 20 for adjusting fixation of the pressing member 13.

The pressing member 13 of the second embodiment having the detachable and replaceable head element 13a is manufactured more easily than the integral pressing member 3 of the first embodiment. The structure of the second embodiment is especially preferable when a working width of the planer is relatively large and the foot element is divided into plural (at least three in the embodiment of FIG. 5) pieces to be fixed to the cutterhead. In the second embodiment, only the head element 13a of the pressing member 13 is replaced by a new one when the edge of the head element 13a is worn over a predetermined limit. This structure effectively reduces the cost required for maintaining the planer. Spring washers or a locking agent may further be used to reinforce the engagement of the head element 13a with the foot element 13b.

In the planer of the first embodiment, position of a pressing portion of the pressing member 3 pressed against the wood surface 1 may be shifted only in a direction along the groove 5 (that is, the cutting direction B and the opposite direction C in FIG. 1). On the other hand, in the structure of the second embodiment with the adjusting screws, the position of the pressing portion of the pressing member 13 may be shifted in two different directions, one along the groove 15 and the other perpendicular to the groove 15. Such two-dimensional displacement of the pressing member allows the pressing portion and a pressing force of the pressing member to be set appropriately according to the properties or conditions of wood, thus more effectively preventing torn grain. This structure with the adjusting screws may also be applicable to the planer of the first embodiment.

The cutterhead 14 of the second embodiment which is symmetrically and integrally formed as shown in FIG. 4 is manufactured more easily than the cutterhead 4 of the first embodiment. The cutterhead of the second embodiment is especially preferable when a working width of the planer is relatively large and the foot element is fixed to the cutterhead at plural places.

In both the first and the second embodiments, a control screw may further be attached to be in contact with the back of the blade for regulating a depth of the blade with respect to the groove. Another control screw may also be attached to be in contact with the foot element of the pressing member for regulating a depth of the pressing member with respect to the groove.

Figure 6:
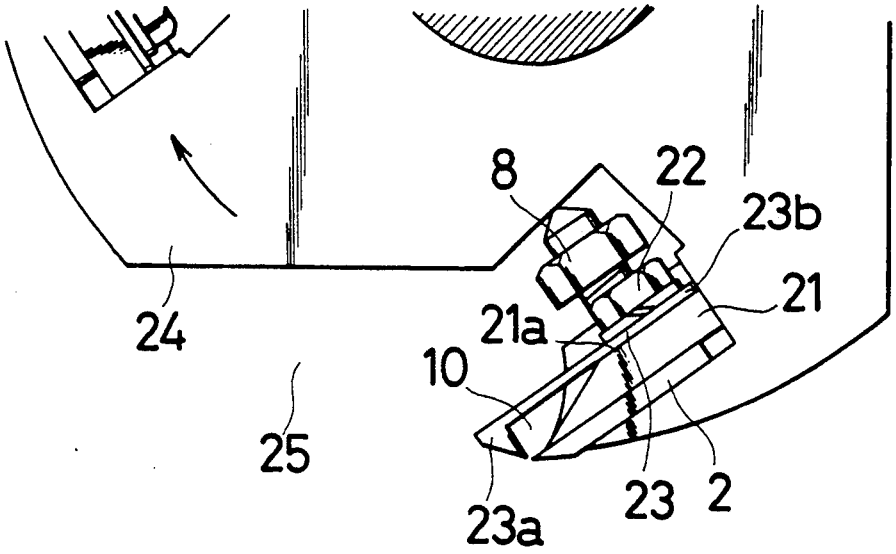
FIG. 6 is a side view showing part of a planer according to a third embodiment of the invention.

In another planer according to a third embodiment of the invention shown in FIG. 6, a smaller-sized pressing member 23 includes a head element 23a and a foot element 23b, which are integrally formed as the pressing member 3 of the first embodiment. The pressing member 23 is fixed to a cutterhead 24 including at least one groove 25 and a fixing member 21 for securely supporting both the blade 2 and the pressing member 23. The fixing member 21 further includes a step 21a for receiving the foot element 23b of the pressing member 23. The foot element 23b of the pressing member 23 is fixed to the fixing member 21 by means of an engagement bolt 22.

The smaller-sized pressing member of the third embodiment requires a shallower groove than the pressing member of the first or second embodiment. The planer of the third embodiment can thus include a larger number (four in the embodiment of FIG. 6) of blades and pressing members, which reduces a cutting load applied on each blade but restricts the movable range of the pressing member. The structure of the third embodiment is thereby not suitable for a planer wherein the maximum thickness of chips may significantly vary to exceed a predetermined limit.

Figure 7:
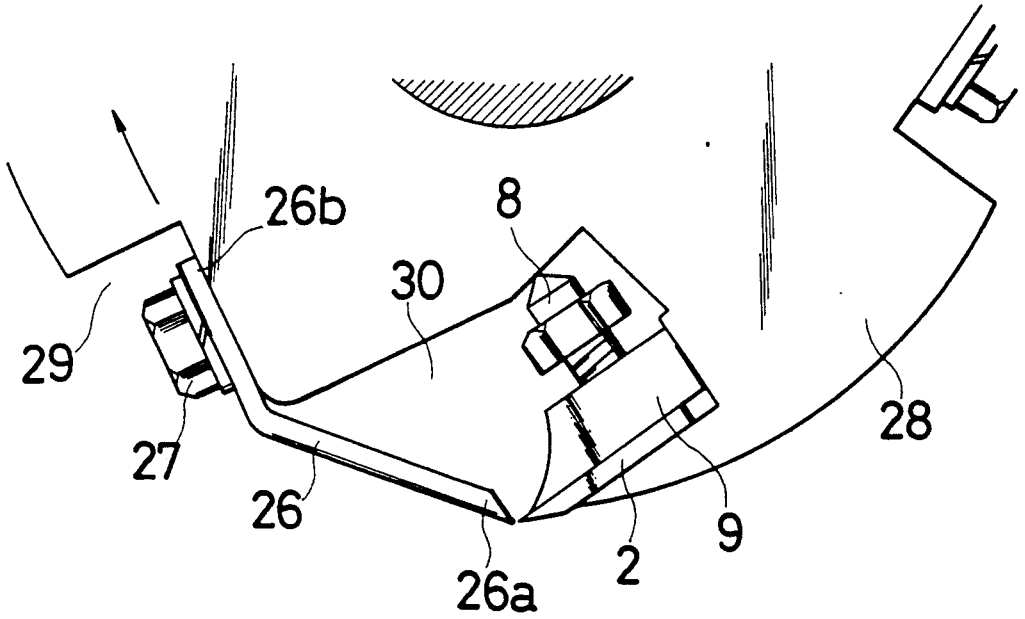
FIG. 7 is a side view showing part of a planer according to a fourth embodiment of the invention.

In still another planer according to a fourth embodiment of the invention shown in FIG. 7, a curved pressing member 26 includes a head element 26a and a foot element 26b which is fixed to a cutterhead 28 by means of an engagement bolt 27. The cutterhead 28 includes a groove 29 having a shape corresponding to the pressing member 26. This structure also includes a wider space 30 for receiving chips cut from the wood surface.

Figure 8:
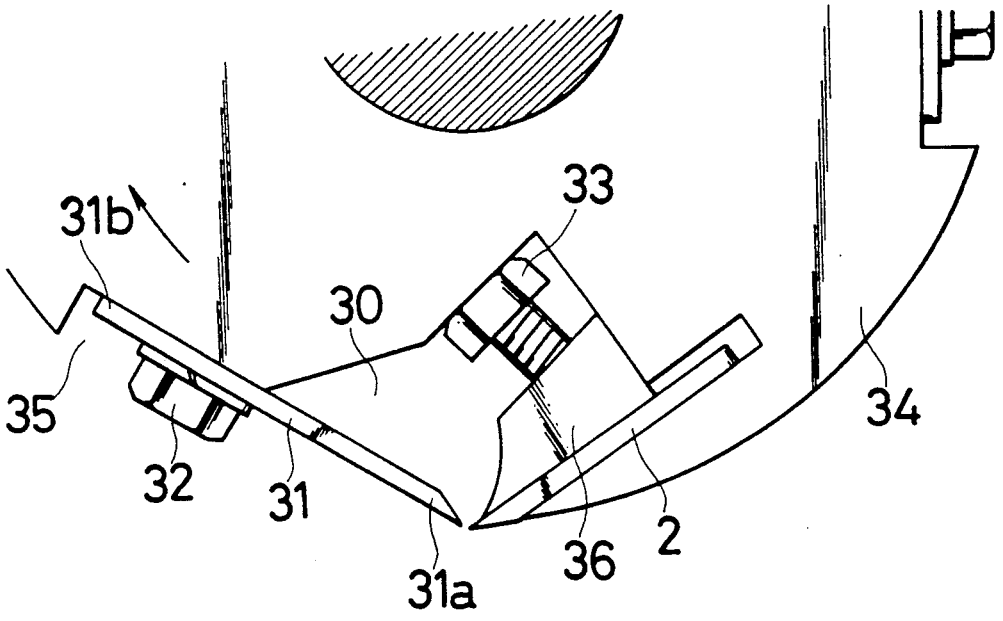
FIG. 8 is a side view showing part of a planer according to a fifth embodiment of the invention.

In another planer according to a fifth embodiment of the invention shown in FIG. 8, a straight pressing member 31 includes a head element 31a and a foot element 31b which is fixed to a cutterhead 34 by means of an engagement bolt 32. In this structure, the blade 2 is pressingly mounted on the cutterhead 34 having a groove 35 by means of a pressing bolt 33 and a blade fixing member 36.

The pressing member of the fourth or fifth embodiment has a simpler structure or shape and is thereby easily manufactured. In these structures, however, the position of the pressing portion of the pressing member is shifted rather significantly with respect to the cutting edge of the blade while the head element of the pressing member is resiliently moved. When the pressing portion of the pressing member is positioned sufficiently close to the cutting edge of the blade to prevent torn grain, chips undesirably remain between the blade and the pressing member to interfere with smooth cutting of the subsequent portion of wood. These structures are thus not suitable for cutting relatively soft wood.

Figure 9:
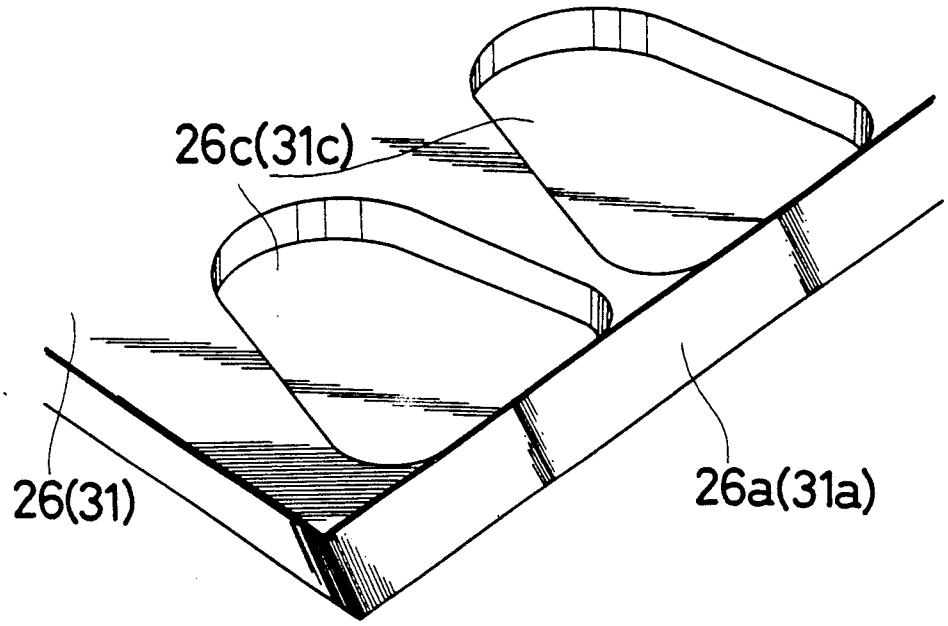
FIG. 9 is an enlarged perspective view showing part of a pressing member incorporated in the planer of FIG. 7 or FIG. 8.

In the structure of the fourth or fifth embodiment, the space for receiving chips cut from the wood surface is relatively large with respect to the size of the chips. As mentioned above, when a working width of the planer is relatively small, chips are smoothly flown out of the relatively large space in a direction transverse to the cutting direction. Removal of the chips from the space may further be accelerated by forming a specific shape of groove gradually widened towards one direction of the cutterhead or by circulating compressed air towards one direction of the cutterhead. Although the pressing member does not require any opening for allowing passage of chips in the structure of the fourth or fifth embodiment, the pressing member may include at least one opening 26*c* or 31*c* having a virtually triangular shape with round corners as shown in FIG. 9 or an elliptical or virtually square shape other than the shape of the opening 3*c* of the first embodiment according to the requirements. Such openings are preferably formed when the working width of the planer is relatively large or a smaller pressing force is desirable.

In any of the above first through fifth embodiments, each pressing member may be divided into plural pieces in a direction of a core shaft of the cutterhead. Such divided structure is especially preferable when the working width of the planer is relatively large. In this case, the plural pieces of the pressing member may be arranged without any clearance or at predetermined intervals. This structure allows individual adjustment of each piece of the pressing member, thus lowering the allowable limit of the required working accuracy.

In any of the above embodiment, the pressing member is composed of a resilient body which presses a desirable portion using elasticity and centrifugal force of rotation. In a preferable procedure, a specification (for example, shape, position of fixation, and material) of the pressing member is temporarily determined according to known equations and then eventually selected according to experiments. The pressing member is, however, not limited to such a resilient body, but may be composed of a rigid non-resilient body having substantially no elasticity. In the latter case, a specific resilient member is attached to the pressing member to give required elasticity.

Figure 10:
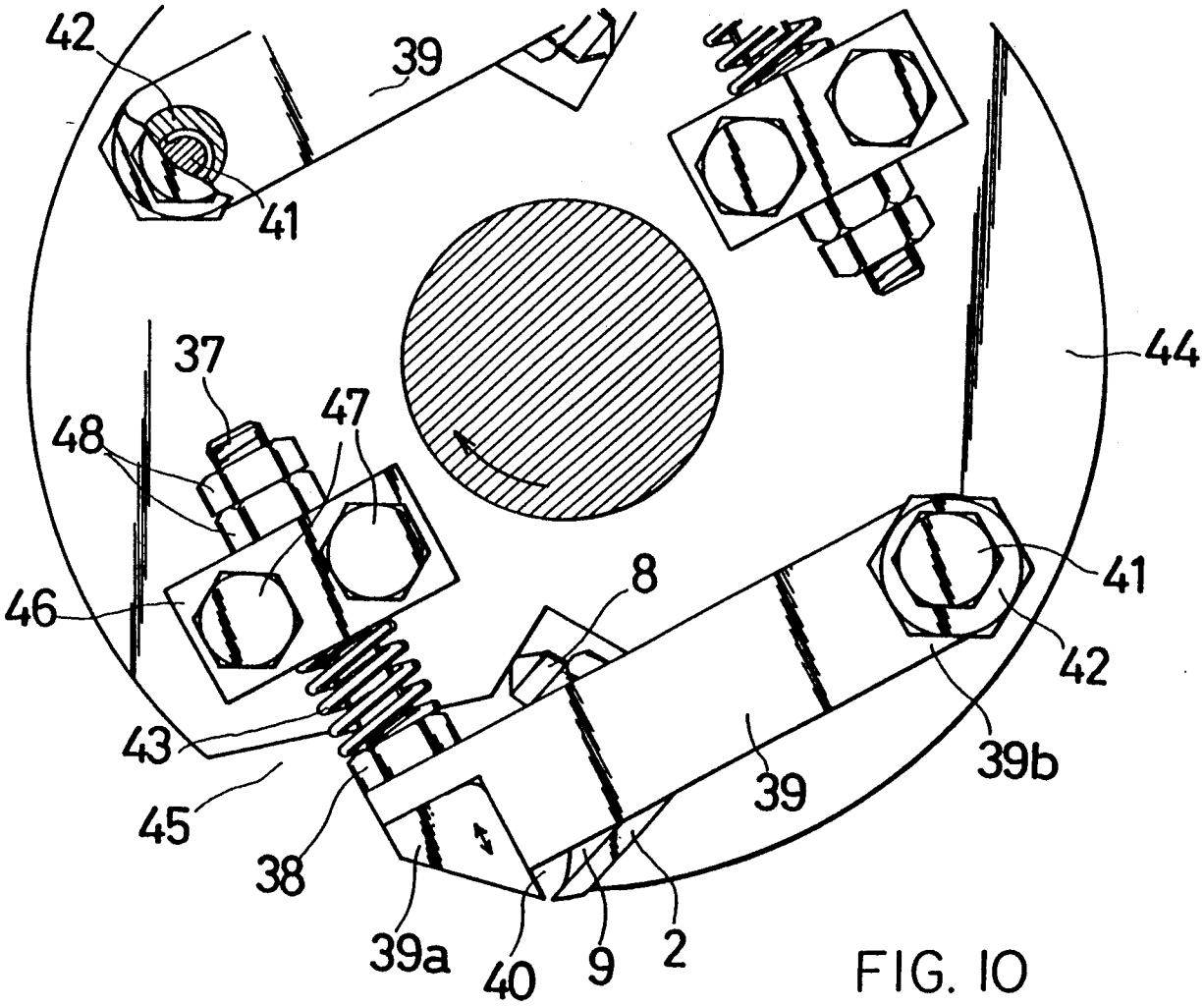
FIG. 10 is a partly broken side view showing part of a planer according to a sixth embodiment of the invention.
Figure 11:
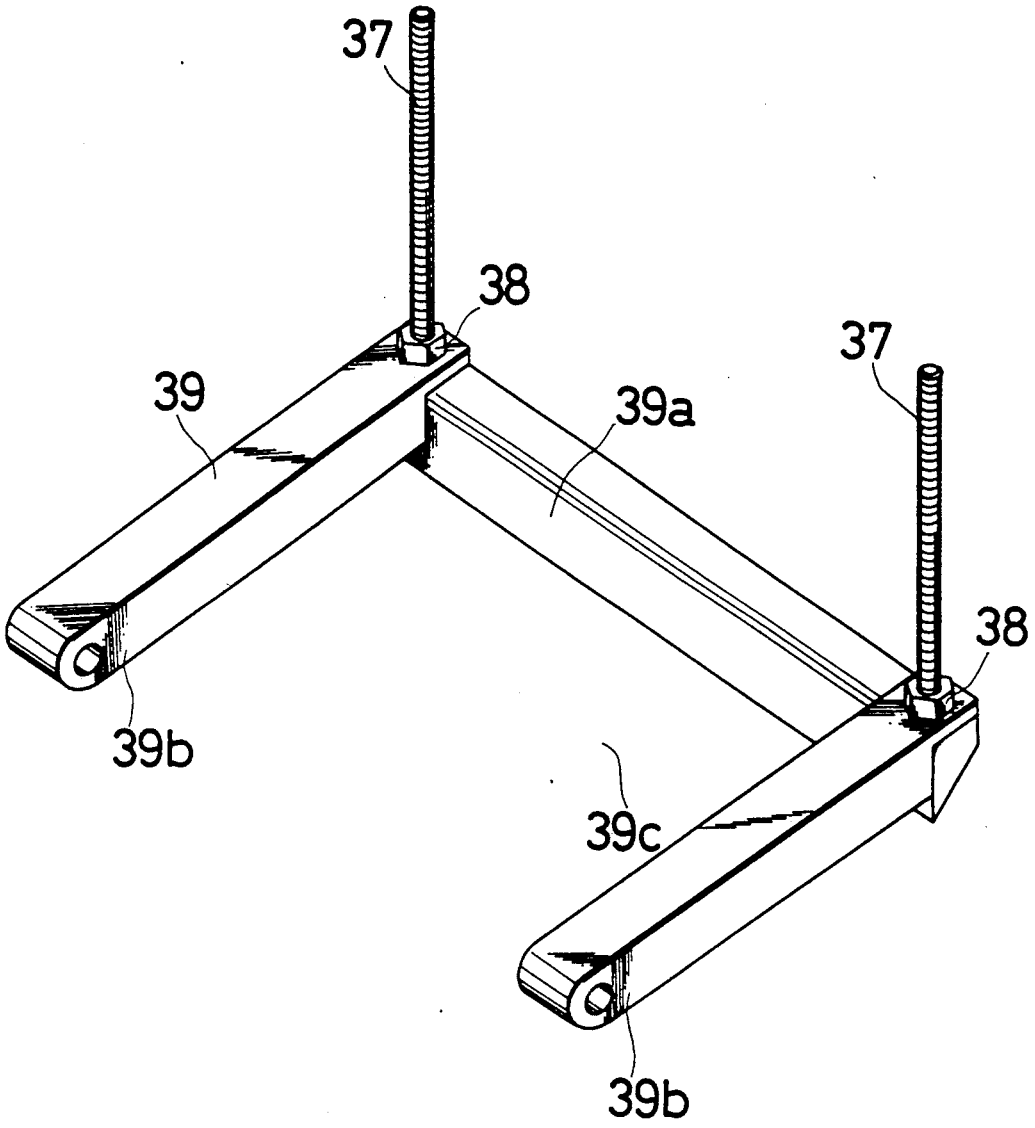
FIG. 11 is a perspective view illustrating a pressing member incorporated in the planer of FIG. 10.

FIG. 10 shows a planer having such structure as a sixth embodiment of the invention, and FIG. 11 illustrates a pressing member 39 incorporated in the planar of FIg. 10. The rigid pressing member 39 includes a detachable and replaceable head element 39*a* fixed to a pair of foot elements 39*b* each by means of a fixation bolt 37 and a fixation nut 38. An opening 39*c* formed between the foot elements 39*b* for allowing passage of chips is arranged facing to a space 40 for receiving chips cut from the wood surface. Each of the foot elements 39*b* is pivotably attached to each side of a cutterhead 44 having at least one groove 45 via an eccentric collar 42 having a hexagonal head and an engagement bolt 41. A resilient member 43 having a spring thereon is disposed, preferably in a slightly compressed condition, between the fixation nut 38 and a stopper 46 having a through hole 8 not shown) for receiving the fixation bolt 37 so as to give a sufficient pressing force of the resilient member 43 to the head element 39*a* of the pressing member 39. The stopper 46 is fixed to each side of the cutterhead 44 by means of mounting bolts 47. A projection degree of the head element 39*a* of the pressing member 39 is regulated by control nuts 48.

The structure of the sixth embodiment having the rigid pressing member 39 and the resilient member 43 has similar effects to those of the resilient pressing member of the other embodiments. In this structure, centrifugal force of rotation significantly affects the specification of the pressing member, which is pivotably attached to the cutterhead.

In the structure of the sixth embodiment, each of the foot elements 39*b* of the pressing member 39 is pivotably mounted on each side of the cutterhead 44 via the eccentric collar 42, and the projection of the head element 39*a* of the pressing member 39 is regulated by the control nut 48. This allows two-dimensional displacement of the pressing portion of the pressing member 39 with respect to the wood surface. An initial pressing force of the resilient member 42 may be adjusted or regulated by an adjusting nut (not shown) or a movable stopper.

Although the head element of the pressing member is formed separately from the foot element in the sixth embodiment, the head element and the foot element may integrally be formed as some of the above embodiments. In the structure of the sixth embodiment, another resilient member having a similar or different specification to or from the resilient member 43 disposed on each side of the cutterhead 44 may further be attached on a central portion of the cutterhead. In this case, the additional resilient member is formed to be gradually tapered in a direction of the core shaft of the cutterhead not to prevent passage of chips.

In any of the above embodiments, a chip cutter having a sufficiently sharp cutting edge being in contact with or intersecting with the cutting edge of a blade may be attached to a rake face of the blade for cutting chips into smaller pieces to allow smoother removal of chips.

Since there may be a variety of other modifications, changes, and alterations without departing from the scope or spirit of essential characteristics of the invention, it is clearly understood that the above embodiments are only illustrative and not restrictive in any sense. For example, the cutterhead, the fixing member, or the blade may have any known structure or shape which does not prevent accommodation of the pressing member and its resilient displacement. The planer may include any desirable number of blades with a corresponding number of pressing members. The conventional measures described above may also be applicable to the planer of the invention; for example, giving an appropriate bevel to a rake face of the blade in order to make a cutting angle greater than a tooth angle, or mounting a chip breaker on the side of the rake face of the blade. In the latter case, the chip breaker may be formed as part of the blade fixing member.

The spirit and scope of the present invention is limited only by the terms of the appended claims.

What is claimed is:

1. A planer having at least one blade attached to and supported on a cutterhead for cutting wood chips from a wood surface for rough finishing, said planer further comprising at least one pressing member mounted on said cutterhead, wherein said pressing member includes a head element having an edge which is located to have a predetermined angle with respect to said blade and is resiliently movable in a predetermined direction to bring said edge of said head element into contact with a selected portion of the wood surface located immediately before a cutting edge of said blade moving in a fixed direction for cutting or alternatively on a boundary between the wood surface and a chip being currently cut from said wood surface by said blade, and a foot element having a first end attached to said cutterhead and a second end, said second end constituting said head element.

2. A planar in accordance with claim 1, wherein said second end of said foot element is integral with said head element.

3. A planer in accordance with claim 1, wherein said second end of said foot element is coupled with said head element by means of a fixing member.

4. A planer in accordance with claim 1, wherein said foot element of said pressing member further comprises an opening which allows passage of the wood chips and is arranged such that said opening faces a space defined by said blade and said pressing member for receiving chips cut from the wood surface.

5. A planer in accordance with claim 4, wherein said foot element includes at least two integral parts, and said opening is formed between said foot element and said head element.

6. A planer in accordance with claim 4, wherein said opening is configured to have a substantially triangular shape with round corners.

7. A planer in accordance with claim 4, wherein said opening has a substantially square shape with round corners.

8. A planer in accordance with claim 4, wherein said opening has an elliptical shape.

9. A planer in accordance with claim 4, wherein said pressing member is composed of a resilient material.

10. A planer in accordance with claim 4, wherein said pressing member is composed of a rigid material.

11. A planer in accordance with claim 10, wherein said pressing member further comprises a resilient member having a spring mounted thereon, said resilient member and said spring cooperating to apply a downward force onto said pressing member.

12. A planer in accordance with claim 4, wherein said head element of said pressing member is configured to have a substantially triangular prism shape.

13. A planer in accordance with claim 4, wherein said cutterhead further comprises a groove, a main body, and a cover member attached to said main body by a fixing member.

14. A planer in accordance with claim 1, wherein said cutterhead further comprises aperture means for receiving at least one adjusting screw adapted for adjusting the position of said pressing member relative to said cutterhead.

15. A planer in accordance with claim 1, wherein said head element of said pressing member is located perpendicular to said foot element.

16. A planer in accordance with claim 2, wherein said second end of said foot element is arranged to be substantially straight.

17. A planer in accordance with claim 2, wherein said second end of said foot element is arranged to be curved by a selected angle.

18. Planer apparatus for cutting wood chips from a piece of wood, said apparatus comprising cutterhead means having a main body coupled to a cover element, cutting means, coupled to said cover element and movable along a cutting axis, for cutting at least one woodchip from a selected portion of said wood, and pressing means mounted with said cutterhead means and arranged in substantially close proximity to said cutting means for applying a selected pressure to said wood chip, said pressing means disposed, in one orientation, immediately before said cutting means during cutting of said wood chip.

19. Planer apparatus according to claim 18 wherein said pressing means comprises a pressing member having a head portion disposed immediately before said cutting means, and a foot portion having a first end and a second end.

20. Planer apparatus according to claim 19 wherein said foot portion second end is integrally arranged with said head element, and said first end is attached to said cover element.

21. Planer apparatus according to claim 19 wherein said foot portion second end is integrally arranged with said head element, and said first end is attached to said cutterhead main body.

22. Planer apparatus according to claim 19 wherein said head element has a substantially triangular prism shape.

23. Planer apparatus according to claim 18 further comprising fixing means for securing said blade to said cover element.

24. Planer apparatus according to claim 19 further comprising adjusting means for adjusting the position of said pressing member head in relation to said blade.

25. Planer apparatus according to claim 19 wherein said pressing member head is covered with an anti-abrasion layer.

* * * * *